US007010952B2

(12) United States Patent
Hofmann et al.

(10) Patent No.: US 7,010,952 B2
(45) Date of Patent: Mar. 14, 2006

(54) DEVICE FOR HOLDING AT LEAST ONE ROLLER OF A ROLLING MACHINE

(75) Inventors: Günter Hofmann, Coburg (DE); Stelios Katsibardis, Coburg (DE); Siegfried Hausdörfer, Mitwitz (DE); Henry Zwilling, Sonneberg (DE); Günther Vogler, Rödental (DE)

(73) Assignee: Langenstein & Schemann GmbH, Coburg (DE)

( * ) Notice: Subject to any disclaimer, the term of this patent is extended or adjusted under 35 U.S.C. 154(b) by 185 days.

(21) Appl. No.: 10/811,631

(22) Filed: Mar. 29, 2004

(65) Prior Publication Data

US 2004/0200251 A1 Oct. 14, 2004

(30) Foreign Application Priority Data

Apr. 14, 2003 (DE) ..... 103 17 312

(51) Int. Cl.
*B21B 31/00* (2006.01)

(52) U.S. Cl. ..... 72/237; 72/108; 72/239; 72/252.5; 492/1; 492/47

(58) Field of Classification Search ..... 72/108, 72/237, 238, 239, 249, 252.5; 29/895.2, 29/895.22; 492/1, 38, 39, 47
See application file for complete search history.

(56) References Cited

U.S. PATENT DOCUMENTS 2,332,859 A * 10/1943 Kreissig et al. ..... 464/58
2,430,683 A * 11/1947 O'Malley ..... 464/154
4,866,969 A * 9/1989 Reismann et al. ..... 72/238
5,450,740 A * 9/1995 Lovinggood et al. ..... 72/182
5,782,125 A * 7/1998 Faggiani et al. ..... 72/237
6,109,085 A * 8/2000 Kikuchi et al. ..... 72/238
6,418,845 B1 * 7/2002 Satoh et al. ..... 101/216

* cited by examiner

*Primary Examiner*—Ed Tolan
(74) *Attorney, Agent, or Firm*—Workman Nydegger

(57) ABSTRACT

A device for holding at least one roller of a rolling machine that can rotate about a rotational axis includes two holding arrangements that can be arranged on opposite faces of the roller viewed in the direction of the rotational axis. The device further includes at least two coupling parts each configured for a coupled mode and an uncoupled mode. A first of the two coupling parts has at least one, preferably essentially straight first groove, and has a second groove that does not run parallel to the first groove. A second of the two coupling parts includes a first coupling element and a second coupling element, wherein the first coupling element projects further outward from the second coupling part than the second coupling element. In at least one implementation, the roller can be detached or removed from the holding arrangements when the holding arrangements are in uncoupled mode.

39 Claims, 5 Drawing Sheets

DEVICE FOR HOLDING AT LEAST ONE ROLLER OF A ROLLING MACHINE

CROSS-REFERENCE TO RELATED APPLICATIONS

This application claims the benefit of priority under 35 U.S.C. § 119 to German Patent Application No. 103 17 312.9 in accordance with the Paris Convention for the Protection of Industrial Property (613 O.G. 23, 53 Stat. 1748); which was filed in the German Patent and Trade Mark office on Apr. 14, 2003, entitled "Vorrichtung zum Halten Wenigstens einer Walze einer Walzmaschine", the application of which is incorporated herein by reference in its entirety.

BACKGROUND OF THE INVENTION

1. The Field of the Invention

The invention relates to a device for holding at least one roller of a rolling machine and a rolling machine.

2. The Relevant Technology

Rolling methods that involve compressive forming are among many methods that are used in forming work pieces from an initial shape into a desired intermediate shape (semi-finished product, pre-forming) or final shape (end product, final forming). In the rolling process, the work piece (rolling stock) is arranged between two rotating rollers, and subjected to a forming pressure exerted by the rotating rollers to alter its shape. In the roll forming method, work piece sections are arranged on the periphery of the rollers, which enable the generation of corresponding profiles in the work piece. In flat rolling, the cylindrical or conical outer surfaces of the rollers act directly on the work piece.

In terms of the relative movement of tools or rollers on the one hand, and the work piece on the other, rolling methods are divided into "longitudinal rolling", "transverse rolling" and "cross rolling". In longitudinal rolling, the work piece is moved through a gap between the rollers (roller gap) that is perpendicular to the rotational axes of the rollers in a translational motion, most often without rotating. In transverse rolling, the work piece does not move in a translational motion, relative to the rollers or their rotational axes, but rather turns only around its own axis. Its own axis is a principal axis of inertia, such that the principal axis of inertia is a symmetrical axis, given a rotationally symmetrical work piece. The combination of both types of movement involved in longitudinal and transverse rolling is referred to as "cross rolling". The rollers are here generally slanted relative to each other such that the work piece is moved translationally and rotationally.

Grooved cross rolling machines typically include two rollers with wedge-shaped profiled tools, and are arranged on the rolling machines' outer periphery. The two rollers rotate in the same direction about parallel rotational axes, and are sometimes also referred to as "cross wedge rollers". The profiled tools have a wedge-shaped or triangular (at the cross-section) geometry as their axial dimensions along the periphery either increase in one direction and/or run slanted to the rotational axis of the rollers.

These cross wedge rollers, or grooved cross rollers, enable a versatile forming of work pieces within high precision, and dimensional accuracy. The wedge-shaped tools can produce continuous grooves and other tapers in the rotating work piece. Axial shifts in the peripheral direction, or a slanting of tool wedges relative to the rotational axis, make it possible to generate changing structures and tapers in the work piece axially with respect to the rotational axis, for example. Increasing or decreasing the outer diameter of the tool wedge while proceeding around the rotational axis makes it possible, in combination with the slanted arrangement, to generate axially-running slants and continuous transitions between two tapers of varying diameter in the work piece. Cross wedge rollers are particularly suited for manufacturing elongated, rotationally symmetrical work pieces with constrictions or elevations, such as with cams or ribs.

German Patent Application No. DE 1 477 088 C describes a cross wedge rolling machine for transversely rolling rotational solids or flat work pieces with two working rollers rotating in the same rotational direction, whose rolling surfaces accommodate exchangeable wedge tools. The wedge tools each have wedge-shaped (or triangular) reduction strips that ascend from the roller jacket to an end height tailored to the work piece to be manufactured, and are roughened such as by knurling, along with wedge-shaped, smooth forming surfaces with a calibration effect spaced identically apart from the roller jacket. The wedge tools are designed as deformation segments, and only traverse a partial area of the accompanying roller surface. The facing surfaces and tools of the two working rollers move or rotate in an opposite direction relative to each other on the work piece.

German Patent Application No. DE 39 26 356 C2 describes a rolling machine with exchangeable working rollers. Each of the working rollers is provided on one face with a cylindrical tap mounted on a divided clamping element of a drive shaft, wherein a movable clamping part of the clamping element is connected with a fixed clamping part at least by one screw and one nut. The opposing face of each working roller exhibits a cylindrical tap mounted on a divided clamping element of the thrust cylinder, whose moveable clamping part is again connected with a fixed clamping part by means of at least one screw and one nut. The working shaft is made to rotate by a drive via the drive shaft. The accompanying clamping element and mounted cylindrical tap impart the active torque from the drive shaft to the roller.

German Patent Application No. DE 309 408 C discloses the mount for a typewriter plate.

German Patent Application No. DE 891 642 C discloses a roller mounting plate for a rolling machine. In this known rolling machine, each bearing journal has a coupling flange on the roller stand into which a centering shoulder of the roller body can be inserted without one or both bearing journals axially shifting. The coupling flange can be designed as a pocket, in which the centering shoulder of the roller body is inserted and held in place by an end cap. Bolts or screws can be provided for securing the centering shoulder and coupling flanges to each other.

Accordingly, an advantage in the art can be realized with systems and methods that provide a simple and reliable mount for the roller of a rolling machine, and that provide a corresponding rolling machine for implementing the same.

BRIEF SUMMARY OF THE INVENTION

Implementations of the present invention provide a simple and reliable mount for a roller of a rolling machine.

Implementations of the present invention are achieved according to the invention by a device with the features in claim 1. The device according to claim 1 is suited and intended for holding at least one roller of a rolling machine that canes rotate around a rotational axis, and encompasses two holding arrangements that can be arranged on opposing faces of the roller, (when viewed in the direction of the rotational axis), and at least two holding arrangements that have both a coupled mode (e.g., a power or torque-transmitting mode) for the torque-transmitting linkage of each holding arrangement with the roller and an uncoupled mode (e.g., no-power or torque mode).

The holding arrangements have at least two paired couplings each comprising at least a first groove as well as at least one corresponding first coupling element on the one hand, and at least one second groove not running parallel to the first groove as well as at least one corresponding second coupling element on the other. The first and second groove(s) are formed on a first coupling part, and the first and second coupling elements are formed on a second coupling part of the respective coupling arrangement.

When the coupling arrangement is in coupled mode, the two accompanying nut and coupling element pairs of each coupling arrangement are now engaged, wherein at least the pairing comprised of the second groove(s) and second coupling element(s) are positively engaged. As a result, the rotational motion and torque are synchronously imparted to the roller when at least one of the holding arrangements is turned over the joining surfaces of the coupling arrangement having the active positive fit. At the same time, the roller is prevented from dropping out of the position between the holding arrangements.

In order to replace the roller or equip it with new tools, the roller mount between the holding arrangements is detachable in design. To this end, the roller can be removed from the holding arrangements with the holding arrangements uncoupled.

The rolling machine according to the invention encompasses at least two rollers that can rotate around a respective rotational axis, and in particular can be equipped with tools: at least one rotational drive for rotating the rollers, when forming a work piece that is arranged between the rollers, and a device according for holding the rollers.

The term "forming" as understood herein refers to changing the shape of a work piece into another shape in any way, and including "pre-forming" and "final forming". The rotational axes of the rollers are to be viewed as geometrical or mathematical axes in a Euclidean, three-dimensional space, around which the rollers turn. By contrast, power-transmitting or mechanical axes are referred to as "shafts" in this application.

The respective claims depending from claim 1 and claim 34 describe advantageous embodiments and further developments of the device, along with aspects of the rolling machine.

In general, the first grooves, and preferably the second grooves as well are each formed on a groove base. In a preferred embodiment, the first groove is embedded more deeply than the second groove in each first coupling part of the holding arrangements (alternatively, the groove base is arranged further down), so that the first coupling element does not hit the groove base of the first base when the second coupling element positively engages the second groove. In addition, the coupling elements generally do not abut the groove base of the accompanying grooves when the holding arrangements are coupled, thereby avoiding a geometric correlation. As an alternative, the first grooves and second grooves of the holding arrangements can be downwardly and partially open (i.e., slit-like in design).

The first coupling element of the accompanying second coupling part also positively engages the first groove of the accompanying first coupling part with each of the holding arrangements coupled to additionally stabilize the connection.

The first groove and second groove of the first coupling part of each coupling arrangement are preferably arranged orthogonally relative to each other. This enables an optimal power transmission and mounting in the coupled mode.

The first grooves of the first coupling parts and preferably the second grooves of the first coupling parts are generally continuous in design. However, the second coupling part can encompass at least two respectively separated first coupling elements and two separated second coupling elements, which preferably are arranged on various sides of the rotational axis, and then in particular are separated from each other by a central area around the rotational axis.

The first and second grooves of the first coupling parts, as well as the first and second coupling elements of the second coupling parts each preferably run radially to the rotational axis when the respective coupling arrangement is coupled.

The side walls of the second grooves and the second coupling elements, and also of the first grooves and first coupling elements, to be positively interlocked, are essentially perpendicular and/or flat in design in order to form a good opposite surface of force for the positive fit.

The first grooves are preferably used as guide grooves when assembling or disassembling the rollers. In one embodiment, the first grooves are essentially straight or linear in design. In particular, the first grooves of the first coupling parts are outwardly open at their ends, in order to introduce the first coupling elements along the groove. In addition, the first grooves can outwardly expand at least at one of their open ends and form guide surfaces for the first coupling element to be introduced. Accordingly, the first coupling element can also be tapered at one of its corresponding free ends that correspond or slide thereupon to interface with the guide surfaces of the first groove.

In order to linearly introduce or remove the roller, the first grooves of the first coupling parts of the two holding arrangements are preferably oriented or adjustable essentially parallel to each other.

In order to switch or alternate between the coupled and uncoupled modes of the holding arrangements, at least one positioning arrangement is provided for positioning at least one of the two holding arrangements axially to the rotational axis of the roller, moving them toward each other and away from each other.

The roller can be mounted between the two holding arrangements by moving the roller into a position between the two holding arrangements parallel to the first grooves in a first step with the holding arrangements uncoupled while guiding the first coupling elements in the first grooves of the first coupling parts of both holding arrangements, after which the accompanying holding arrangements are switched to the coupled mode in a second step by feeding at least one of the two holding arrangements to the roller. The roller is then reliably held between the holding arrangements. Proceeding in an opposite manner, the roller is disassembled from the holding arrangements by initially moving the two holding arrangements from their coupled mode to their uncoupled mode by moving at least one of the two holding arrangements away from the roller, after which the roller is moved into a position outside the two holding arrangements while guiding the first coupling elements in a removal direction, or a direction running parallel to the first grove. This simple assembly and disassembly capability is a particular advantage of the invention.

Stop surfaces, which abut each other when the holding arrangements are in couple mode, are arranged or secured on the holding arrangements. In addition the rollers' front sides face each other in order to limit the feeding motion, and to fix the roller in place between the holding arrangements.

In an additional implementation, positioning means are provided for positioning the roller relative to the holding arrangements in a position where the two holding arrangements can be switched from the uncoupled to coupled mode and vice versa. These positioning means are preferably formed with corresponding stop means, which retain or stop the rollers in the direction of introduction. In particular, this position makes it possible to feed the holding arrangements to the roller, for switching the coupling arrangement to its coupled mode, and/or to introduce the second coupling element of the accompanying second coupling part into the second groove of the accompanying first coupling part. In particular, the positioning means can encompass positioning elements that intermesh from the back. In addition, the positioning means are generally designed in such a way as to enable or not impede the feeding motion of the holding arrangements relative to the roller.

The device further includes apparatus configured for holding at least two rollers of a rolling machine that can rotate around a rotational axis, and then encompasses a respective two holding arrangements and a respective two holding arrangements for each of the rollers. The holding arrangements and rollers can be arranged next to each other when assembled, or arranged one over the other viewed in the direction of gravitational force.

At least two rollers can preferably be mounted sequentially in the same direction of introduction or from the same side of the rolling machine and/or the first roller to be mounted can be guided between the holding arrangements of the rollers to be subsequently mounted.

The positioning means are now preferably designed and arranged on the rollers and holding arrangements in such a way that the roller to be mounted first can be guided between the holding arrangements of the rollers to be subsequently mounted, and is or can be positioned only in its desired location between the accompanying holding arrangements of this roller. In particular, in the case of the roller to be introduced or mounted first, the positioning means or stop means are for this purpose arranged at the end of the holding arrangement viewed in the direction of introduction, and at the front side of the roller on their faces or sides viewed in the direction of introduction, and the positioning means or stop means of a second roller to be mounted after the first roller are arranged at the beginning of the holding arrangement viewed in the direction of introduction, and on the faces or sides of the roller on the back side viewed in the direction of introduction.

A special embodiment now makes it possible to incorporate at least two rollers between the accompanying holding devices in an unmistakable or clearly allocated fashion, in particular via the configuration of the accompanying holding arrangements and/or the accompanying positioning means.

The rolling machine generally encompasses bearing arrangements for each holding arrangement, in which the holding arrangements are rotationally supported.

The rotational axes of the rollers mounted in the holding arrangements are generally oriented essentially parallel to each other and/or essentially arranged over each other viewed in the direction of gravitational force and/or essentially perpendicular to the direction of gravitational force.

In a particularly preferred embodiment, the rolling machine is designed as a grooved cross-rolling machine or cross wedge rolling machine, whose basic structural design was described at the outset. In particular, the rollers exhibit profiled or wedge-shaped tools, and rotate in the same direction toward each other, wherein the work piece only rotates around its own axis, and is not translationally transported by the rollers, as opposed to longitudinal rollers. The tools on the rollers are wedge-shaped or triangular, in particular in terms of their cross section, and increase in radial dimensions in one direction along the periphery and/or run slanted relative to the rotational axis of the accompanying roller.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

Identical parts and dimensions in FIGS. 1 to 11 are denoted with the same reference symbols.

DETAILED DESCRIPTION OF THE PREFERRED EMBODIMENTS

Figure 1:
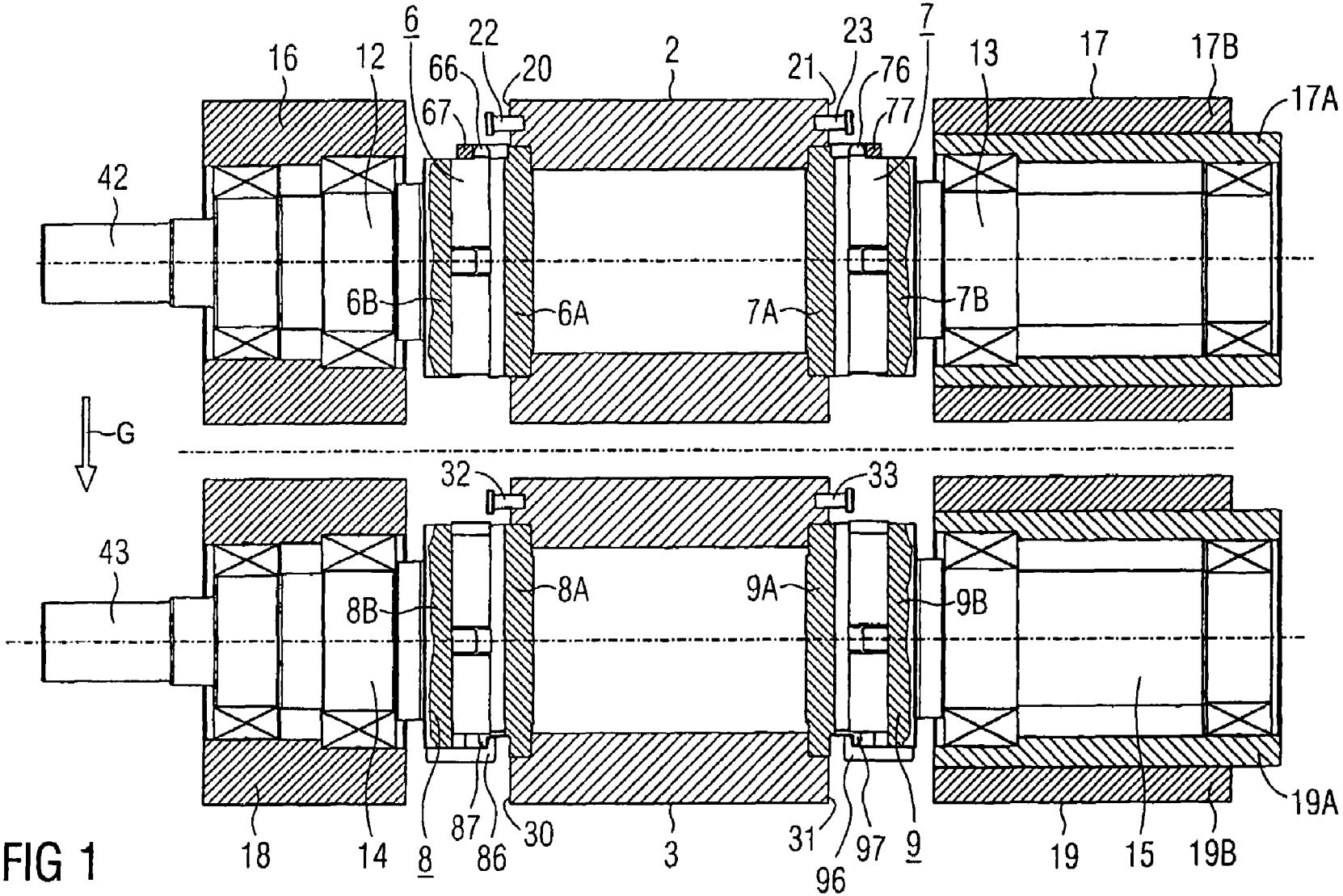
FIG. 1 is a device for holding two rollers of a rolling machine situated one over the other, longitudinal section.

The device shown in FIG. 1 illustrates holding two working rollers 2 and 3, and part of a rolling machine. In particular, FIG. 1 illustrates a cross wedge roller, or cross wedge rolling machine.

The first working roller 2 rotates around a rotational axis A, and the second working roller 3 rotates around a rotational axis B. The rotational axes A and B are essentially arranged parallel to each other or perpendicular to the direction of the forces of gravity (or earth's attraction) denoted with the arrow, so that both working rollers 2 and 3 are arranged one right over the other.

The working rollers exhibit an essentially cylindrical outer surface. Segmented or fully continuous tools each having a wedge-shaped cross section (not shown) are generally secured, in particular braced or bolted, to the outer surface or jacket surface of the working rollers 2 and 3, and each are slanted and arranged at an angle relative to the respective rotational axis A and B and axially arranged relative to the rotational axes A and B in essentially the same positions. Viewed in the peripheral direction, the tools advantageously also increase in cross section, wherein the increase in cross section proceeds in a direction opposite to the tools of different working rollers 2 and 3.

The left face 20 of the first, upper working roller 2 in FIG. 1 is provided with a flange-like first coupling part 6A of a coupling arrangement 6, while the other, right face 21 is provided with a flange-like first coupling part 7A of a coupling arrangement 7. The left face 30 of the second, lower working roller 3 in FIG. 1 is also provided with a flange-like first coupling part 8A of a coupling arrangement 8, and the other, right side 31 is provided with a flange-like first coupling part 9A of a coupling arrangement 9. In addition to the first coupling parts 6A, 7A, 8A and 9A, the holding arrangements 6 to 9 each encompass respectively corresponding, also flange-like second coupling parts 6B, 7B, 8B and 9B, which are arranged or formed on a respective accompanying holding arrangement 12, 13, 14 and 15 designed as a rotating shaft.

The holding arrangements 12 and 13 for the upper working roller 2 are rotationally supported in accompanying bearing arrangements 16 and 17 around rotational axis A by means of roller bearings (not designated in any greater detail). The holding arrangements 14 and 15 for the lower working roller 3 are rotationally supported in accompanying bearing arrangements 18 and 19 around rotational axis B by means of roller bearings (not designated in any greater detail). The holding arrangement 12 of the first working roller 2 and the holding arrangement 14 of the second working roller 3 each exhibit a shaft extension as a drive shaft 42 or 43, which can each be connected or coupled with one or a shared rotational drive (not shown).

The holding arrangements 6 to 9 are coupled in FIG. 1, i.e., their coupling parts 6A and 6B, 7A and 7B, 8A and 8B as well as 9A and 9B intermesh. As a result, the upper first working roller 2 and the lower second working roller 3 are clamped or held between the accompanying holding arrangements 12 and 13 or 14 and 15 axially to their respective rotational axis A or B on the one hand, and torques or rotations of the holding arrangements 12 and 14 are conveyed synchronously via drive shafts 42 and 43 to the working rollers 2 and 3 and the opposing holding arrangements 13 and 15 on the other.

Each of the working rollers 2 and 3 can now be removed from the holding arrangements 12 and 13 or 14 and 15 by uncoupling the accompanying holding arrangements 6 and 7 or 8 and 9, and taken out of the arrangement for purposes of replacing the tools or all working rollers 2 and 3.

The structural design and function and the holding arrangements 6 to 9 will be explained in greater detail by way of example based on the holding arrangements 6 and 8 along with FIG. 2 to 11.

Figure 2:
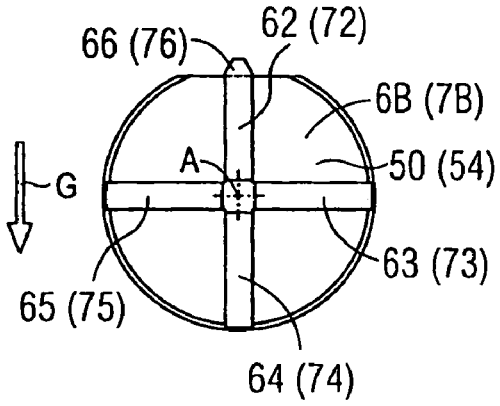
FIG. 2 is a front view of the face of a holding arrangement for the upper roller according to FIG. 1, including a coupling part with coupling elements.
Figure 3:
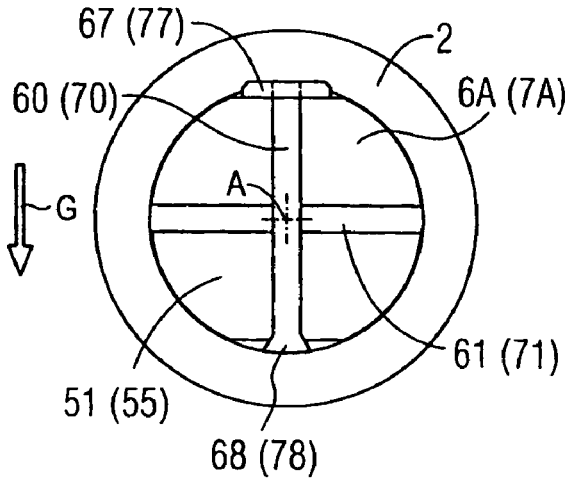
FIG. 3 is a front view of the face of the upper roller according to FIG. 1, including a coupling part with coupling grooves.
Figure 4:
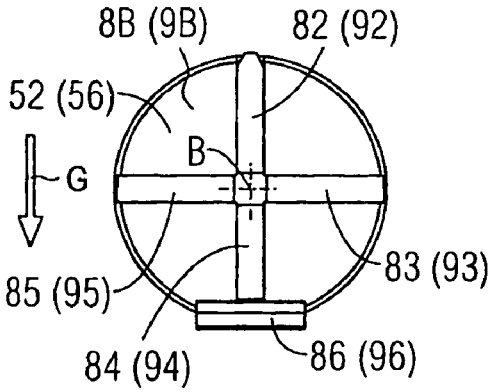
FIG. 4 is a front view of the face of a holding arrangement for the lower roller according to FIG. 1, including a coupling part with coupling elements.
Figure 5:
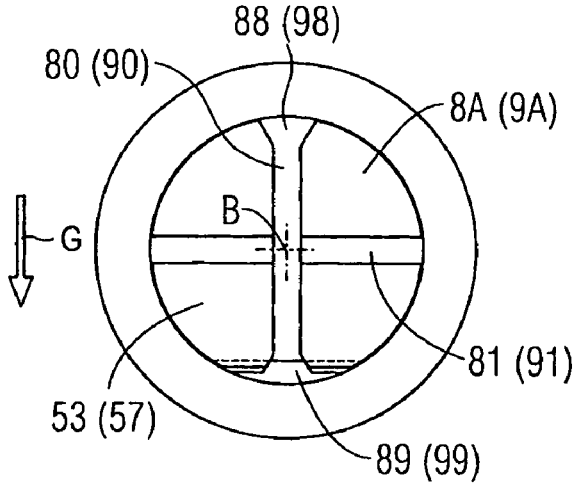
FIG. 5 is a front view of the face of the lower roller according to FIG. 1, including a coupling part with coupling grooves.
Figure 6:
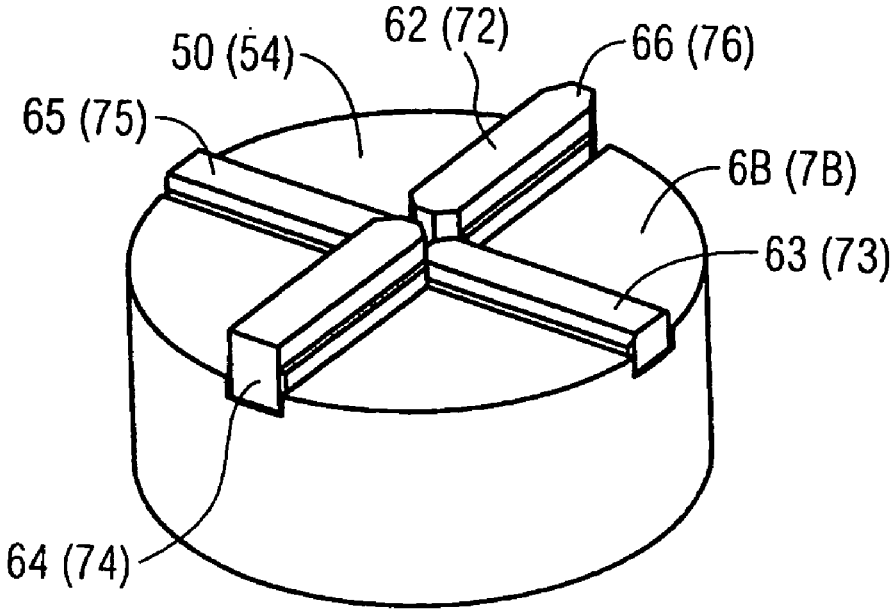
FIG. 6 is a three-dimensional view of a second coupling part with four radial coupling elements.
Figure 7:
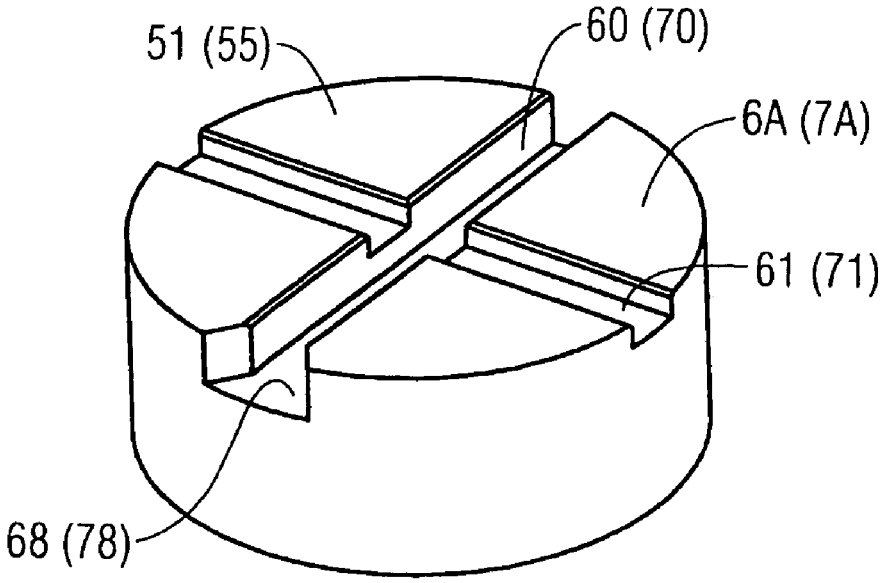
FIG. 7 is a three-dimensional view of a first coupling part corresponding to the second coupling part according to FIG. 6, with two radial coupling grooves.
Figure 8:
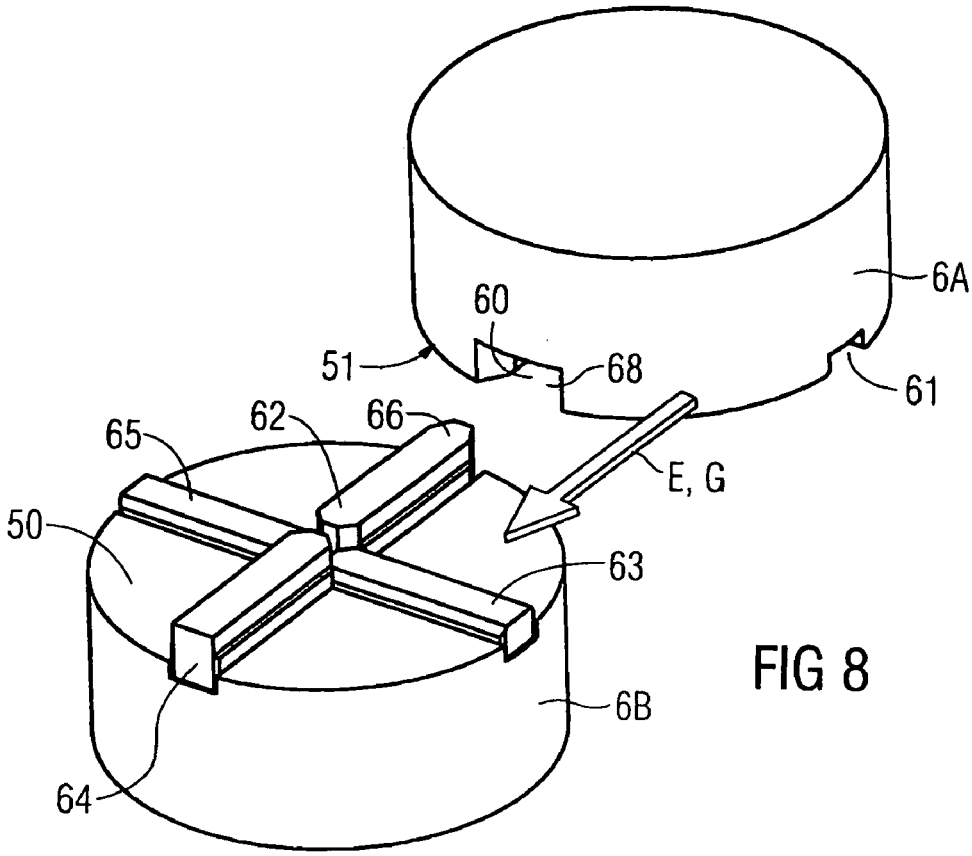
FIG. 8 is a three-dimensional view of the first coupling part according to FIG. 7 and the second coupling part according to FIG. 6 just prior to radial introduction.
Figure 11:
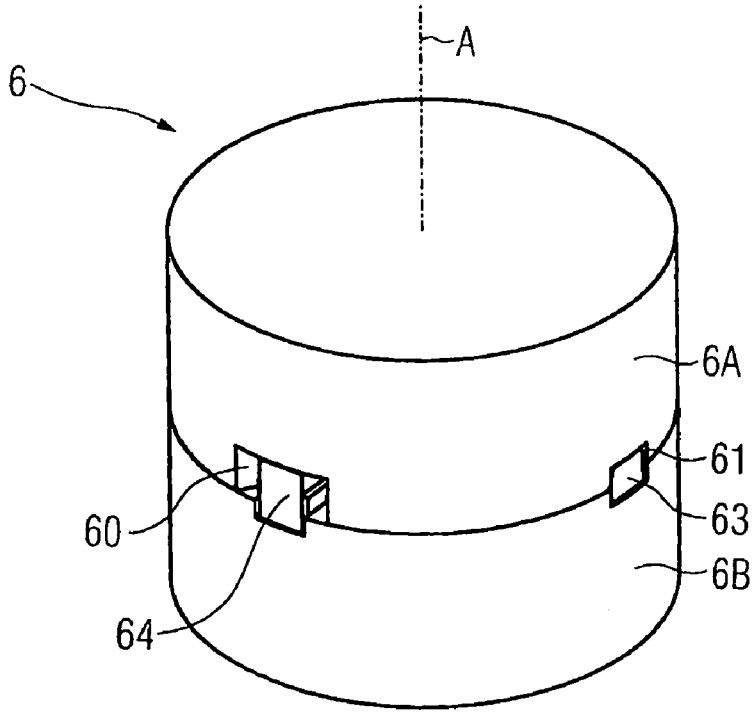
FIG. 11 is a three-dimensional view, rotated by 180° relative to the view in FIG. 10, of the first coupling part according to FIG. 7 and the second coupling part according to FIG. 6 after coupling.

FIG. 2 and FIG. 6 show the second coupling part 6B or 7B, and FIG. 3 and FIG. 7 show the first coupling part 6A or 7A of the coupling arrangement 6 or 7 for the upper working roller 2. FIG. 4 shows the second coupling part 8B, and FIG. 5 shows the first coupling part 8A of the coupling arrangement 8 for the lower working roller 3. FIG. 8 and 11 further illustrate the two coupling parts 6A and 6B in varying positions. Both coupling parts 6A and 6B have the basic shape of a cylinder, with rotational axis A as the cylindrical axis. Coupling arrangement 7 is structurally identical to coupling arrangement 6, while coupling arrangement 9 is structurally identical to coupling arrangement 8, as highlighted by the corresponding reference numbers placed in parentheses.

Two continuous grooves 60/80 and 61/81 intersecting in the area of rotational axis A or B and oriented orthogonally relative to each other and radially to the rotational axis A or B are provided in the first coupling part 6*a* or 8A, and exhibit at least primarily a rectangular cross section or straight, perpendicular side walls. The first groove 60 or 80 is deeper or displaced further inward than the second groove 61 or 81.

The second coupling part 6B or 8B exhibits four radially running coupling elements 62, 63, 64 and 65 (or 82, 83, 84, and 85) protruding or projecting axially to the rotational axis, which are offset by 90° relative to each other, and separated from each other in the area of rotational axis A or B by a central intermediate space. The coupling elements 62 and 64 or 82 and 84 are provided and designed for engaging the first groove 60 or 80 of the first coupling part 6A or 8A, and the coupling elements 63 and 65 or 83 and 85 for engaging the second groove 61 or 81. The coupling elements 62 and 64 or 82 and 84 are here higher or designed to project further than the coupling elements 63 and 65 or 83 and 85.

The first grooves, e.g., 60 and 80, and the accompanying coupling elements, e.g., 62 and 64 or 82 and 84, of all holding arrangements 6 to 9 are oriented vertically or parallel to the gravitational force G, and the second grooves, e.g., 61 and 81, and the accompanying coupling elements, e.g., 63 and 65 and 83 and 85, are correspondingly oriented horizontal or perpendicular to the gravitational force G.

The bearing arrangements 17 and 19 now each have two bearing parts 17A and 17B or 19A and 19B, which can each be moved or adjusted relative to each other between two set positions axially or parallel to the rotational axis A or B and fixed in the set positions. This creates a setting arrangement for axially feeding or removing the holding arrangement 13 or 15 axially fixed in the bearing part 17A to or from the working roller 2 or 3. The setting arrangement can also encompass a drive for automatic feeding or removal.

The upper edge of the second coupling part 6B of the coupling arrangement 6 exhibits a cut-off area for the upper working roller 2, in which the coupling element 62 protrudes upwardly and narrows, forming guide surfaces. The protruding area of the coupling element 62 and the cut-off upper edge of the second coupling part 6B together comprise a positioning element 66. The upper edge of the first coupling part 6A has a loop-shaped receptacle for the positioning element 66 of the coupling element 62, which forms an additional positioning element 67 and also sits on the cut-off area of the second coupling part 6B if the cylindrical axes of the coupling parts 6A and 6B coincide on rotational axis A.

The lower edge of the first coupling part 8A of the coupling arrangement 8 for the lower working roller 3 exhibits a cut-off area with a hook-shaped extension as the positioning element 86. The lower edge of the second coupling part 8B also exhibits a hook-shaped extension as the positioning element 87, wherein the two hook-shaped positioning elements 86 and 87 intermesh from the back and abut each other if the cylindrical axes of the two coupling parts 8A and 8B coincide on rotational axis B.

In order to assemble working rollers 2 and 3, the accompanying bearing parts 17A or 19A along with the accompanying holding arrangements 13 or 15 are first moved out to the outer set position as appropriate. The lower working roller 3 with its two first coupling parts 8A and 9A can be initially guided from above between the sufficiently spaced two upper holding arrangements 12 and 13 and the coupling parts 6B and 7B. The design of the positioning elements 87 and 97 on the one hand, and of the positioning elements 66 and 76 on the other, ensures that the lower working roller 3 can pass the upper holding arrangements 12 and 13.

The working roller 3 with the first grooves 80 and 90 is subsequently threaded in the vertical insertion direction E (i.e., oriented parallel to the gravitational force G) over or on the coupling elements 82 and 92, as shown in FIG. 8 for coupling arrangement 6. A narrowed section at the beginning of the coupling element 82 and 92 and an expanded section 89 or 99 at the lower entrance of the groove 80 or 90 here serve as guides or stop faces or lacing aids. The grooves 80 and 90 are now guided onto the coupling elements 82 and 92, and then on the coupling elements 84 and 94 of the second coupling parts 8B and 9B, until the positioning elements 87 and 97 of the working rollers 2 and 3 hit the accompanying positioning elements 86 and 96 of the lower holding arrangements 14 and 15. The set positions of the holding arrangements 14 and 15 are here selected in such a way that the coupling elements 82 and 84 as well as 92 and 94 engage the respective guiding grooves 80 and 90 on either side, and are guided by longitudinally running side walls. The two coupling parts 8A and 8B as well as 9A and 9B are arranged concentrically to rotational axis B in the end position of the working roller 3 defined by the positioning elements 86, 87, 96 and 97 when hooked together.

Figure 9:
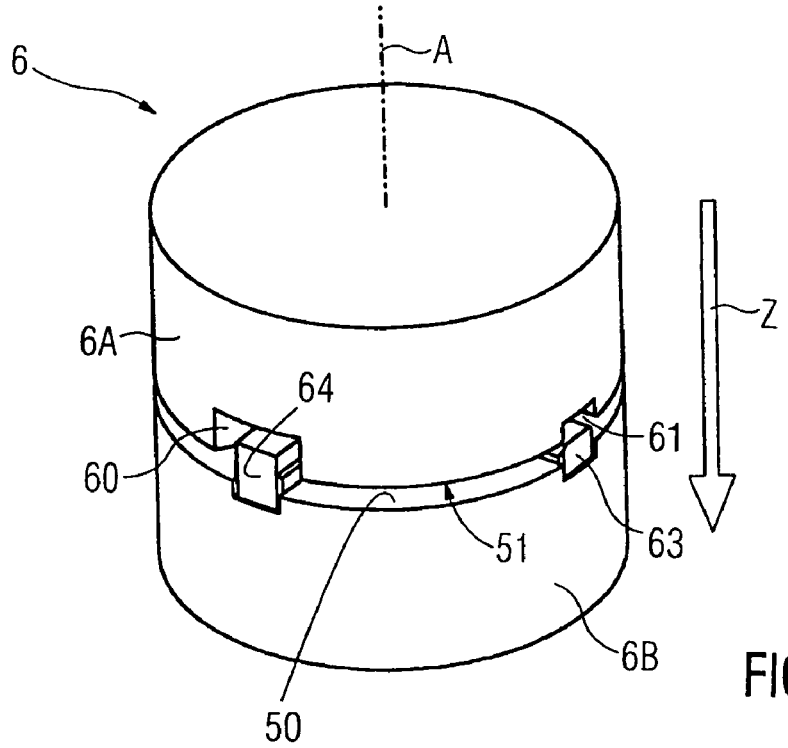
FIG. 9 is a three-dimensional view of the first coupling part according to FIG. 7 and the second coupling part according to FIG. 6 after introduced and just prior to coupling.

The transversely running coupling elements 83 and 85 as well as 93 and 95 are now engaged in the transversely running second grooves 81 and 91 by axially feeding the holding arrangement 15 in forward direction Z coaxially to the rotational axis B (as shown in FIG. 9 for coupling arrangement 6). The shape of coupling elements 82 to 85 as well as 92 to 95 can be adjusted to the grooves 80 and 81 as well as 90 and 91 in such a way as to generate a positive fit at least on the longitudinally running side walls during this engagement. The mutually abutting flat sides or stop surfaces 52 and 53 or 56 and 57 of the coupling parts 8B and 8A or 9B and 9A limit this feeding movement before the coupling elements 82 to 85 as well as 92 to 95 hit the groove base of the respective grooves 80 and 81 as well as 90 and 91. The two holding arrangements 8 and 9 are now coupled, and a stable, torque-transmitting connection is realized between the working roller 3 and holding arrangements 14 and 15.

In addition to the lower expansions 89 and 99, the first grooves 80 and 90 also exhibit upper expansions 88 and 98. This is advantageous when guiding the lower working roller 3 with its grooves 80 and 90 on the coupling elements 62 and 64 and 72 and 74 of the upper coupling parts 6B and 7B as it passes between the upper holding arrangements 12 and 13, since this facilitates both upward and downward lacing. All grooves can also be contacted at the upper edge (see FIG. 7).

Following this assembly of the lower working roller 3, the upper working roller is mounted in similar fashion in an initial step by lacing or fitting it from above with the first grooves 60 and 70 of its first coupling parts 6A and 7A on the coupling elements 62 or 72 in the direction of introduction E (FIG. 8). In this case, the narrowing area of the coupling element 62, which is part of the positioning element 66, and an outwardly enlarging expansion 68 at the beginning of the first groove 60 serve as lacing aids or guides.

After lacing is completed, the grooves 60 and 70 are further guided on the coupling elements 62 and 72 and then on the coupling elements 64 and 74 up to the end position defined by the stop of the positioning elements 66/76 and 67/77, in which axial feeding in the forward direction Z takes place for positively joining the two grooves 61 and 71 with the accompanying coupling elements 63 and 65 or 73 and 75 (FIG. 9).

Figure 10:
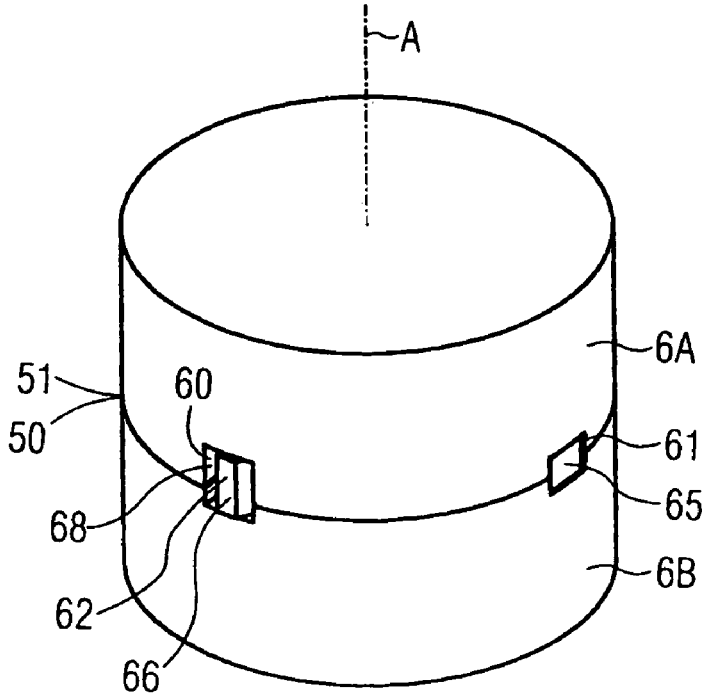
FIG. 10 is a three-dimensional view of the first coupling part according to FIG. 7 and the second coupling part according to FIG. 6 after coupling.

FIGS. 10 and 11 show the coupling arrangement 6 coupled in this way. The frontal stop surfaces 50 of the second coupling part 6B and frontal stop surfaces 51 of the first coupling part 6A are situated one on top of the other, and the coupling elements 62 and 64 positively engage the groove 60 at a distance from the groove base, while coupling elements 63 and 65 engage the groove 61.

The steps mentioned for assembly are performed in reverse order to remove or disassemble the working rollers 2 and 3 in removal direction opposite the advancing direction Z and a withdrawal direction opposite the direction of introduction E.

The faces of the working rollers 2 and 3 each are provided with upper assembly aids 22 and 23 or 32 and 33, so that they can be held during assembly or disassembly.

The described measures have hence been used to easily switch or replace the working rollers 2 and 3 or their tools, and also to reversibly (or irreversibly) incorporate the two working rollers 2 and 3 given the special design of the positioning means 66, 67, 76, 77, 86, 87 and 96, 97.

The coupling parts are preferably made out of steel. The coupling elements can in particular be secured as prefabricated parts in grooves in a second coupling part, e.g., as shown in FIG. 8, or also be molded onto or out of the coupling part itself.

The grooves in the first or second coupling part are preferably generated via material degradation, in particular milling.

The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. In a system comprising a rolling machine used to form work pieces, a device for holding at least one roller in the rolling machine comprising:

at least one roller that can rotate about a rotational axis;

at least two holding arrangements arranged on opposite faces of the at least one roller viewed in the direction of the rotational axis;

at least two coupling arrangements that can be configured in a coupled mode and an uncoupled mode, wherein the at least one roller can be detached from the two holding arrangements when the at least two coupling arrangements are in uncoupled mode, and wherein the at least two coupling arrangements comprise:

a first coupling part including at least a first groove and a second groove that does not run parallel to the first groove; and a second coupling part including at least a first coupling element that projects further outward from the second coupling part than a second coupling element, such that when the at least two coupling arrangements are in coupled mode:

the first coupling element of second coupling part extends into the first groove of the first coupling part; and the second coupling element of the second coupling part positively engages the second groove of the first coupling part.

2. The system as recited in claim 1, wherein the first groove in the first coupling part is embedded more deeply than the second groove of the first coupling part, such that the first coupling element does not hit a groove base of the first groove when the second coupling element positively engages the second groove.

3. The system as recited in claim 1, wherein the first coupling element of the second coupling part positively engages the first groove of the first coupling part relative to its side walls when each of the at least two holding arrangements coupled.

4. The system as recited in claim 1, wherein the first groove and the second groove comprise a corresponding first and second groove base, and wherein the first and second coupling elements can only abut the corresponding first and second groove base when the at least two holding arrangements are coupled.

5. The system as recited in claim 1, wherein the first groove and the second groove of the first coupling parts of the at least two holding arrangements are open at an end.

6. The system as recited in claim 1, wherein the first groove is positioned orthogonal to the second groove of each first coupling part of the at least two holding arrangements.

7. The system as recited in claim 1, wherein the first and second grooves of the first coupling part can be adjusted essentially parallel to each other.

8. The system as recited in claim 1, further comprising at least one positioning device for setting at least one of the two holding arrangements along the rotational axis in one of a feeding movement toward each other and a removal movement away from each other.

9. The system as recited in claim 1, wherein, in order to mount the at least one roller between the two holding arrangements, the at least one roller is brought into a position between the two holding arrangements in a direction of introduction that is parallel to the first groove when at least two holding arrangements are in uncoupled mode, wherein the accompanying holding arrangements can be switched to coupled mode by feeding at least one of the two holding arrangements to the roller.

10. The system as recited in claim 1, wherein, the at least one roller can be dissembled from the at least two holding arrangements, by performing a method of:

switching the two holding arrangements from an uncoupled mode by moving at least one of the two holding arrangements away from the roller; and bringing the at least one roller into a position outside the two holding arrangements in a withdrawal direction that runs parallel to the first grooves while guiding the first coupling elements out of the first grooves of the at least two holding arrangements.

11. The system as recited in claim 1, wherein stop surfaces that are located on front sides of the at least two holding arrangements abut each other when the at least two holding arrangements are in coupled mode.

12. The system as recited in claim 1, further comprising positioning means for positioning the at least one roller relative to the at least two holding arrangements in such a way that the two holding arrangements can be switched from the uncoupled to the coupled mode.

13. The system as recited in claim 12, wherein the positioning means comprise stop means that stop the movement of the roller in the direction of introduction in a position such that at least two holding arrangements can be fed to the roller to switch the coupling arrangement to its coupled mode by introducing the second coupling element of the second coupling part into the second groove of the first coupling part.

14. The system as recited in claim 1, further comprising at least a second roller; and at least two holding arrangements and two coupling parts for each of the at least one roller and the at least a second roller.

15. The system as recited in claim 14, wherein the at least two holding arrangements and at least first and second rollers are situated next to each other in a vertical position.

16. The system as recited in claim 15, wherein at the least first and second rollers are mounted sequentially, such that the at least a first roller is assembled by guiding the first roller between the at least two holding arrangements of the at least a second roller that is mounted subsequently.

17. The system as recited in claim 16, wherein positioning means are provided in such a way that the at least one roller is guided between the at least two holding arrangements of the at least a second roller, and such that the at least one roller is positioned in the desired location by the positioning means only in its desired setting between the corresponding holding arrangements of at least two holding arrangements.

18. The system as recited in claim 17, wherein any of the positioning means and stop means of the at least one roller are arranged at a lower end of the at least two holding arrangements, and on a front side of the at least one roller; and wherein the positioning means are arranged at an upper end of the a face of the at least two holding arrangements for holding the at least a second roller.

19. The system as recited in claim 17, wherein the at least one and second rollers are non-exchangeably incorporated between the corresponding at least two holding arrangements when using the positioning means.

20. The system as recited in claim 12, wherein the positioning means are configured to allow a feeding motion of the at least two holding arrangements relative to the at least one roller.

21. The system as recited in claim 12, wherein the positioning means comprise positioning elements that interlock at the back surface of the at least one roller.

22. The system as recited in claim 1, wherein the first groove of the first coupling parts are open at least at one of their ends.

23. The system as recited in claim 22, wherein the first groove expand outwardly at least at one of their open ends, and wherein the first groove forms guide surfaces for the first coupling element to be introduced.

24. The system as recited in claim 23, wherein the first coupling element narrows at least at one of its ends that correspondingly fits into an outwardly expanded end of the first groove.

25. The system as recited in claim 1, wherein one or more of the first and second grooves of the first coupling parts are continuous in design.

26. The system as recited in claim 25, wherein the second groove of the first coupling parts is continuous in design.

27. The system as recited in claim 1, wherein the first groove and second groove of the first coupling part and the first coupling element and second coupling element of the second coupling part each run radially from the rotational axis.

28. The system as recited in claim 27, wherein the first groove and second groove of the first coupling part, and the first coupling element and second coupling element of the second coupling part have respective side walls that each run radially from the rotational axis.

29. The system as recited in claim 1, wherein the second coupling part comprises at least two first coupling elements and at least two second coupling elements.

30. The system as recited in claim 29, wherein at least two first coupling elements, and the at least two second coupling elements are arranged on different sides of the rotational axis.

31. The system as recited in claim 1, wherein side walls corresponding to of any the first and second groove and the corresponding first and second coupling element are substantially perpendicular.

32. The system as recited in claim 1, wherein the first coupling part of the at least two holding arrangements is situated on the roller, and the second coupling part is situated on any of the at least two holding arrangements.

33. The system as recited in claim 1, wherein the first coupling element projects axially along the rotational axis farther than the second coupling element.

34. A rolling machine used to form work pieces comprising:

at least two rollers that can rotate around two corresponding rotational axes, and that can be equipped with one or more tools for forming a work piece, at least one rotational drive for rotating the one or more of the at least two rollers such that a work piece is formed when the work piece is arranged between the at least two rollers during a forming phase; and a device for holding the at least two rollers comprising:

two holding arrangements arranged on opposite faces of the at least two rollers viewed in the direction of the rotational axis;

at least two coupling arrangements that can be configured in a coupled mode and an uncoupled mode, wherein the at least two rollers can be detached from the two holding arrangements when the at least two coupling arrangements are in uncoupled mode, and wherein the at least two coupling arrangements comprise:

a first coupling part including at least a first groove and a second groove that does not run parallel to the first groove; and a second coupling part including at least a first coupling element that projects further outward from the second coupling part than a second coupling element, such that when the at least two coupling arrangements are in coupled mode:

the first coupling element of second coupling part extends into the first groove of the first coupling part; and the second coupling element of the second coupling part positively extends into the second groove of the first coupling part.

35. A rolling machine as recited in claim 34, further comprising bearing arrangements for each holding arrangement in which the holding arrangements are rotationally supported.

36. A rolling machine as recited in claim 34, wherein the rolling machine is configured as one of a grooved cross rolling machine and a cross wedge rolling machine.

37. A rolling machine as recited in claim 34, wherein tools on any of the at least two rollers comprise one of a wedge-shaped and triangular cross sectional profiles that increase in radial dimensions in one direction along the periphery, and slant relative to the rotational axis of the corresponding roller.

38. A rolling machine as recited in claim 34, wherein the rotational axes of the at least two rollers are oriented essentially parallel to each other.

39. A rolling machine as recited in claim 34, wherein the rotational axes of the at least two rollers are situated essentially vertically when viewed in the direction of gravitational force.

* * * * *